US007029251B2

(12) United States Patent
Chang et al.

(10) Patent No.: US 7,029,251 B2
(45) Date of Patent: Apr. 18, 2006

(54) BACKPRESSURE MECHANISM OF SCROLL TYPE COMPRESSOR

(75) Inventors: Lung-Tsai Chang, Taoyuan Hsien (TW); Chung-Pen Chiu, Taoyuan Hsien (TW)

(73) Assignee: Rechi Precision Co., Ltd., Taoyuan Hsien (TW)

( * ) Notice: Subject to any disclaimer, the term of this patent is extended or adjusted under 35 U.S.C. 154(b) by 0 days.

(21) Appl. No.: 10/855,641

(22) Filed: May 28, 2004

(65) Prior Publication Data

US 2005/0265880 A1 Dec. 1, 2005

(51) Int. Cl.
*F04C 18/00* (2006.01)
*F03C 2/00* (2006.01)

(52) U.S. Cl. ..... 418/55.5; 418/55.7; 418/55.4; 418/55.1; 277/597

(58) Field of Classification Search ..... 418/55.5, 418/57, 55.1–55.3, 55.6, 55.4; 277/579, 277/422, 482
See application file for complete search history.

(56) References Cited

U.S. PATENT DOCUMENTS 5,447,418 A * 9/1995 Takeda et al. ..... 418/55.5
5,489,198 A * 2/1996 Comparin et al. ..... 418/55.5
RE35,216 E * 4/1996 Anderson et al. ..... 418/55.5
5,562,435 A * 10/1996 Cho et al. ..... 418/55.5
5,580,229 A * 12/1996 Beck et al. ..... 418/57
5,649,816 A * 7/1997 Wallis et al. ..... 418/55.1
6,217,302 B1 * 4/2001 Sun et al. ..... 418/55.5
6,257,852 B1 * 7/2001 Tarng et al. ..... 418/55.5

FOREIGN PATENT DOCUMENTS

JP 05157063 A * 6/1993
JP 06026470 A * 2/1994
JP 06173864 A * 6/1994
JP 06241177 A * 8/1994
JP 11022660 A * 1/1999

* cited by examiner

*Primary Examiner*—Theresa Trieu
(74) *Attorney, Agent, or Firm*—Troxell Law Office, PLLC

(57) ABSTRACT

A backpressure mechanism for a scroll type compressor to effectively prevent leakage of coolant; a recessed seat being provided at the top of a coolant passage at the center of a fixed scroll; a ring groove being disposed on the outer circumference of the recessed seat; a high-pressure sealing assembly comprised of a high-pressure ring, a sealing device and a high pressure ring seat and a medium-pressure sealing assembly comprised of a medium-pressure ring, a sealing device and a medium-pressure ring seat being respectively provided to the recessed seat and the ring groove; pressure from the compressed coolant causing an axially compromising vacuum unloading function to float the both sealing assemblies.

3 Claims, 10 Drawing Sheets

BACKPRESSURE MECHANISM OF SCROLL TYPE COMPRESSOR

BACKGROUND OF THE INVENTION (a) Field of the Invention

The present invention is related to an improved structure of a backpressure mechanism of scroll type compressor (STC), and more particularly, to one that prevents compression coolant leakage.

(b) Description of the Prior Art

Referring to FIGS. 1(A) and 1(B) of the accompanying drawings for a sectional view of a structure among a casing 10, an orbiting scroll 20 and a fixed scroll of a scroll type compressor generally available in the market, the compressor is provided with a backpressure mechanism of the prior art. The compressor essentially works inside the casing 10 by having the orbiting scroll 20 to revolve around the fixed scroll 30. Multiple compression chambers 40 with increased pressure inwardly chamber by chamber as the orbiting scroll 20 revolves around the fixed scroll 30 thus to change the volume of the compression chamber 40 to compress the coolant.

Wherein, the compressed coolant enters into a high-pressure chamber 11 provided in the upper space inside the casing 10 through a central compression chamber 40 of the fixed scroll 30. A ring groove 32 is provided on the outer circumference of a coolant passage 31 at the center of the top of the fixed scroll 30. A bypass pore 33 connected through the compression chamber 40 is provided at the ring groove 32 and a ring 51 is provided at the ring groove 32. A sealing device 60 is separately provided at where the ring 51 and the ring groove 32 are inserted into each other. A ring seat 52 is locked to the center of the ring 51 to press against a separation block 12 disposed below the high-pressure chamber 11, and the sealing device 60 is provided between the ring seat 52 and the ring 51 to define a backpressure mechanism.

The purpose of the backpressure mechanism is to guide partial pressure through the bypass pore 33 into the ring groove 32 while the compressor is running so to push up the ring 51 and the ring seat 52 to further increase the air tightness of the fixed scroll 30 and the separation block 12 for preventing leakage of the compression coolant.

The prior art disclosed above relates to a backpressure mechanism taught in USA Patent Publication Re. 35,216; wherein, both of the ring seat 52 and the ring 51 are adapted in the ring groove 32 at the same time. When the pressure in the medium pressure area of the compressor is greater than that in the high-pressure chamber, the sealing device 60 alone fails to reach complete sealing results, thus to form a leakage passage as illustrated in FIG. 1(B) permitting the coolant in the medium pressure area of the ring groove 32 to leak to the high-pressure chamber 11.

Furthermore, the losing of its intended air-tightness function of the sealing device 60 as the compressor is running, the high pressure in the coolant passage 31 escapes to the medium pressure area in the ring groove 32, resulting in abnormal rise of pressure in the medium pressure area and the power to push the fixed scroll becomes significantly higher than that as designed. Consequently, the operation efficacy of the entire backpressure mechanism is discounted, and the compressor efficiency compromised if not failed.

SUMMARY OF THE INVENTION

The primary purpose of the present invention is to provide an improved structure of a backpressure mechanism of a scroll type compressor to upgrade the operation efficiency of the compressor. To achiever the purpose, a recessed seat is provided on the top of a coolant passage located at the center of a fixed scroll and a ring groove is provided on the outer circumference of the recessed seat. Wherein, a floating high-pressure sealing assembly is disposed at the recessed seat, a floating medium-pressure sealing assembly is disposed at the ring groove, and a bypass pore connecting through a compression chamber is provided to the ring groove of the fixed scroll to make sure that both of the high-pressure and the medium-pressure sealing assemblies float and plunge against a separation block located below the high-pressure chamber while the pressure from the compressed coolant enables the fixed scroll to produce an axially compromising and vacuum unloading function to upgrade the operation efficiency of the compressor

DETAILED DESCRIPTION OF THE PREFERRED EMBODIMENTS

Figure 1A:
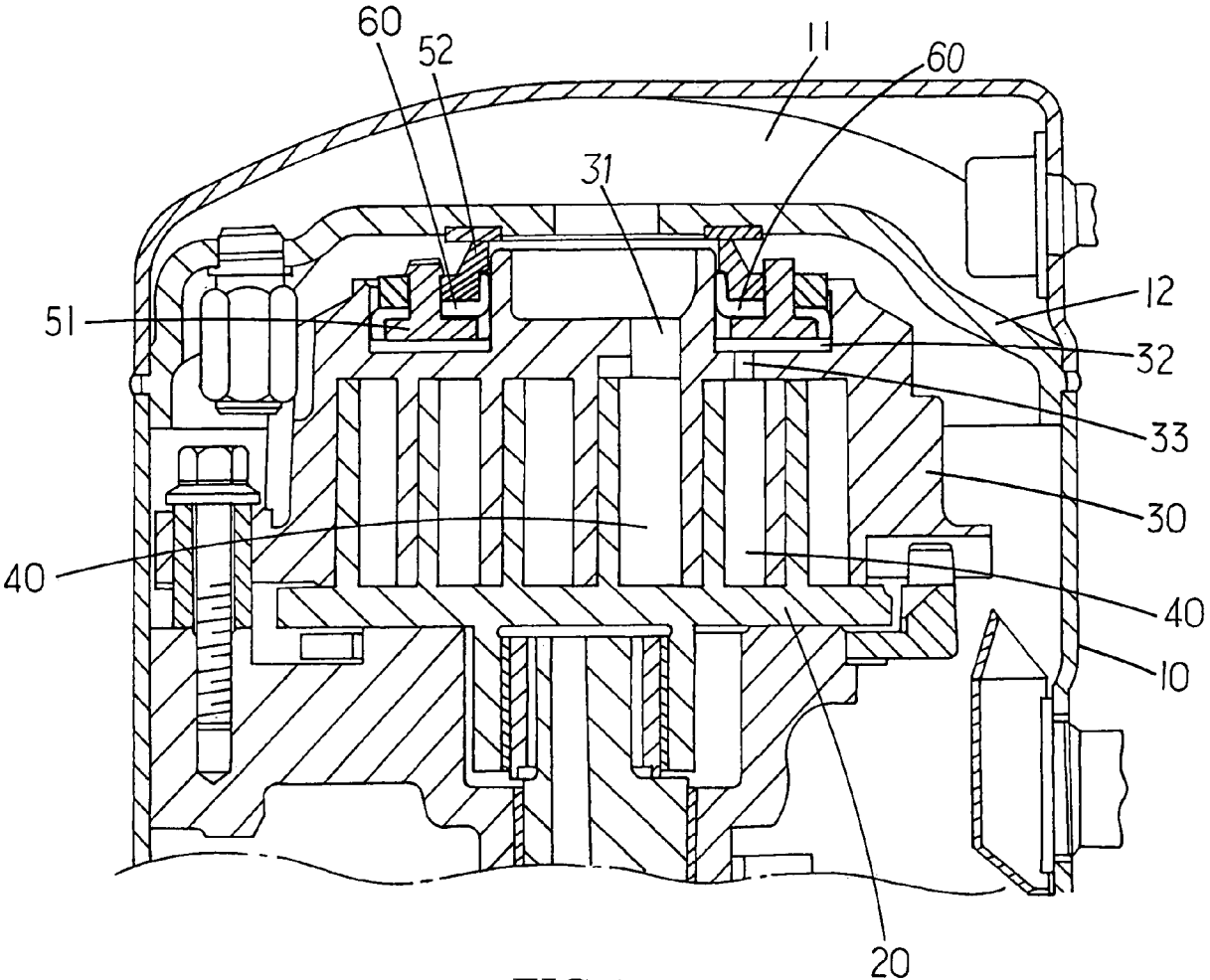
FIG.1 A Prior Art
FIG. 1(A) is a sectional view of a casing, an orbiting scroll and a fixed scroll provided with a backpressure mechanism of the prior art.
Figure 1B:
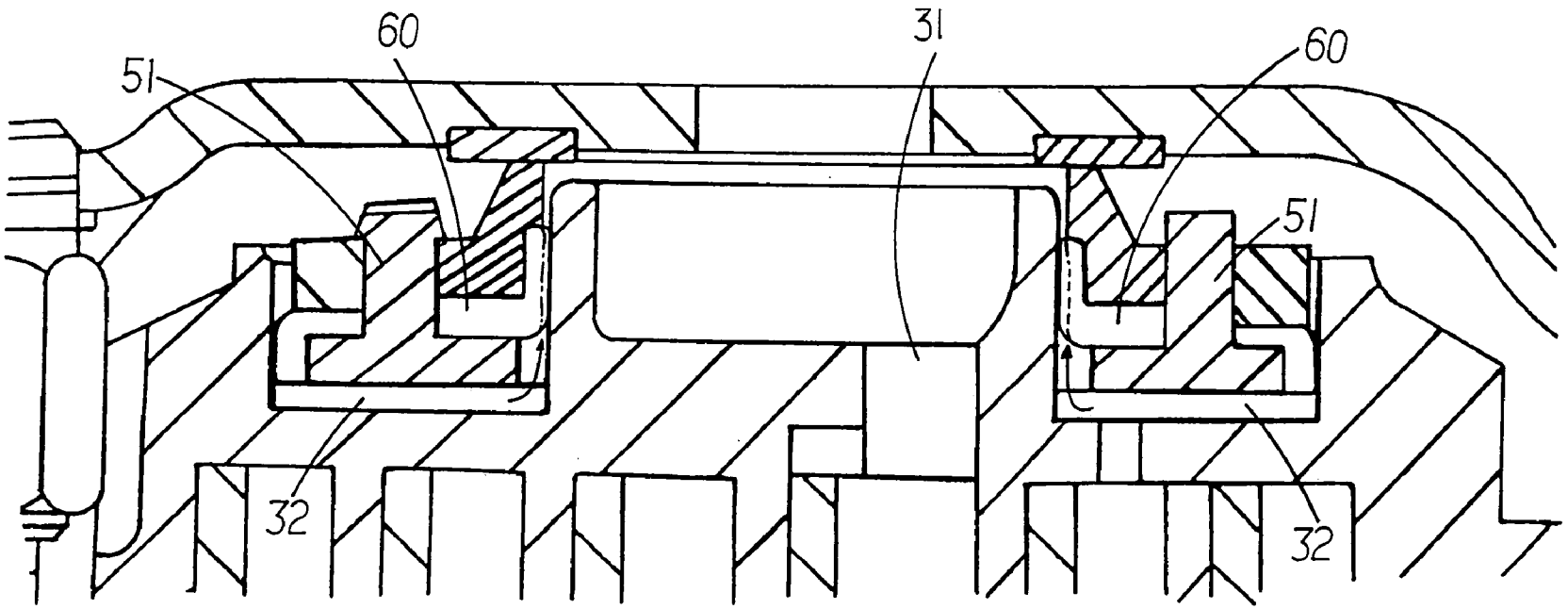
FIG.1B Prior Art
FIG. 1(B) is a magnified view of the backpressure mechanism taken from FIG. 1(A).
Figure 2A:
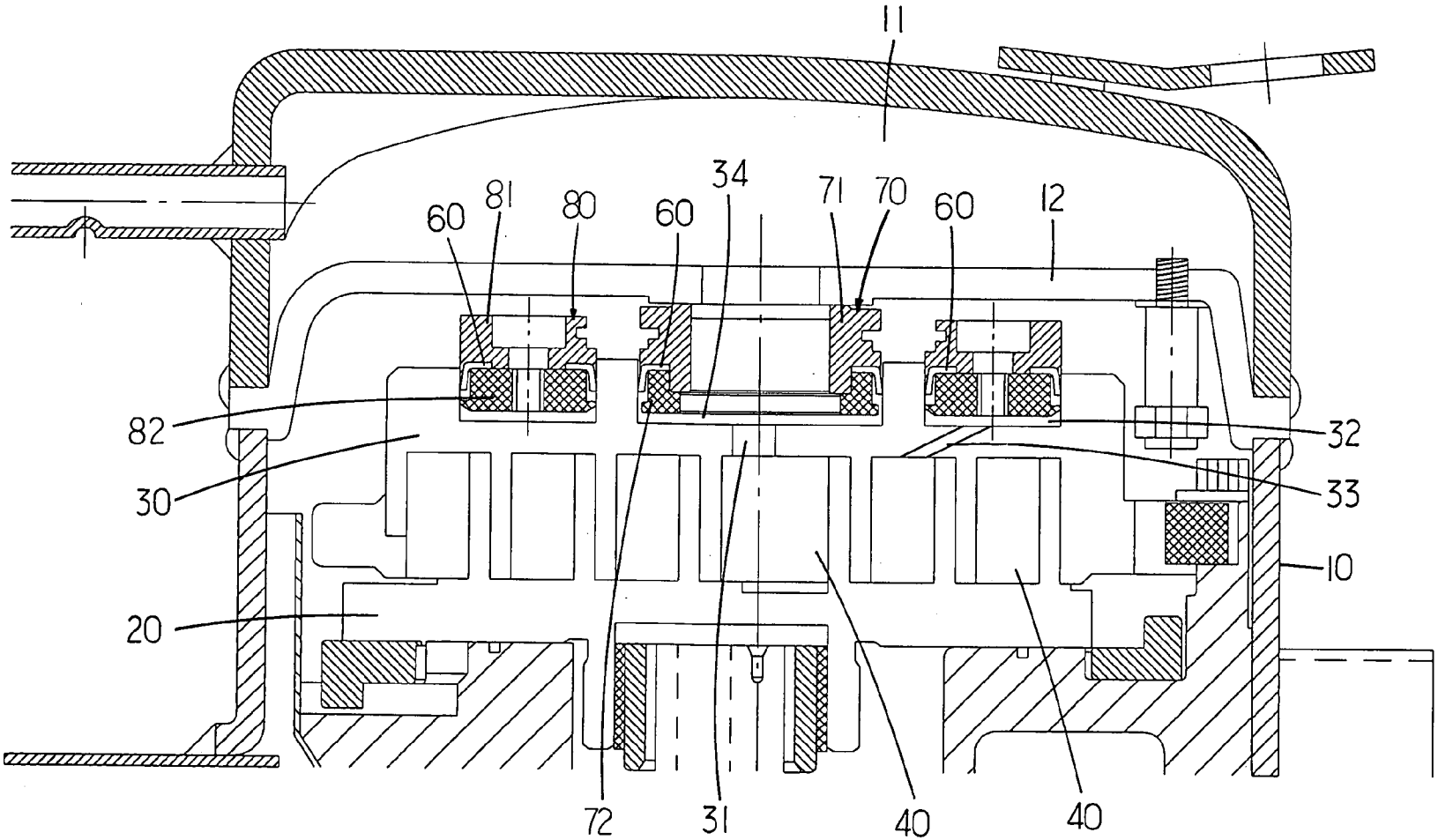
FIG. 2(A) is a sectional view showing a backpressure mechanism of a first preferred embodiment of the present invention.

Referring to FIG. 2(A) for a backpressure mechanism of a scroll type compressor of the present invention, the compressor essentially operates by having an orbiting scroll 20 to revolve around a fixed scroll 30 inside a casing 10 so to cause the pressure gradually and inwardly increasing through multiple compression chambers 40 thus to change the volume of each compress chamber 40 for compressing a coolant. A space in the upper area inside the casing is segregated into a high-pressure chamber 11 by means of an separation block 12, and the compressed coolant passes via a compression chamber 40 located at the center of the fixed scroll 30 through a coolant passage 31 provided in the center of the fixed scroll 30 to enter into the high-pressure chamber 11.

Wherein, a recessed seat 34 is disposed at the top of the coolant passage 31 at the center of the fixed scroll 30, and a ring groove 32 is provided on the outer circumference of the recessed seat 34. A sealing assembly comprised of a high-pressure sealing ring 71, a sealing device 60, and a high-pressure sealing ring seat 72 in descending order is provided in the recessed seat 34. A medium-pressure sealing assembly 80 comprised of a medium-pressure sealing ring 81, another sealing device 60 and a medium-pressure sealing ring seat 82 is disposed at the ring groove 32. A bypass pore 33 connecting through one compression chamber 40 is provided to the ring groove of the fixed scroll. Accordingly, it is made sure that both of the high-pressure and the medium-pressure sealing assemblies 70, 80 float and plunge against the separation block 12 disposed below the high-pressure chamber to effectively prevent the compressed coolant from leaking out of the fixed scroll 30 in conjunction with the sealing device 60. Meanwhile, the pressure from the compressed coolant causes the fixed scroll 30 to produce an axially compromising and vacuum unloading function to upgrade the operation efficiency of the compressor.

Any leakage from a sealing device essentially takes place in the passages respectively between the high-pressure chamber and the low-pressure chamber, and the medium-pressure chamber to the low-pressure chamber. In the present invention, abnormal rise of the pressure in the medium-pressure chamber will not occur even provided with poor airtight function of the sealing device.

Figure 2B:
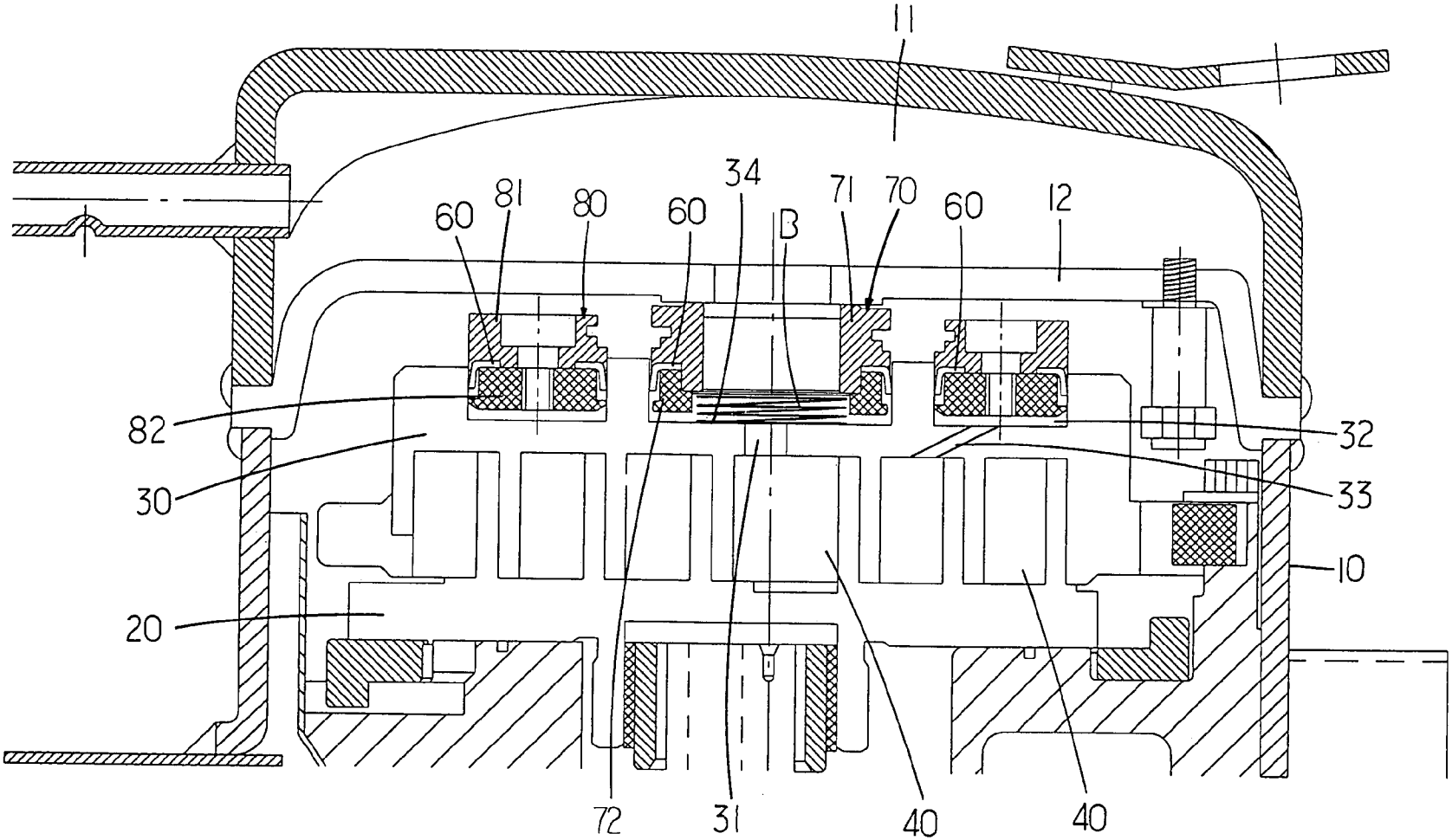
FIG. 2(B) is another sectional view showing the backpressure mechanism of the first preferred embodiment of the present invention.

An elastic member is provided to the high-pressure sealing assembly 70 in the ring groove 32 in the form of a coil B in the preferred embodiment of the present invention as illustrated in FIG. 2(B). The coil B produces a regular force of elasticity to plunge upwards against the high-pressure sealing assembly 70 to make sure that the high-pressure sealing assembly 70 is close engaged with the separation block 12 to prevent leakage of pressure.

Figure 3:
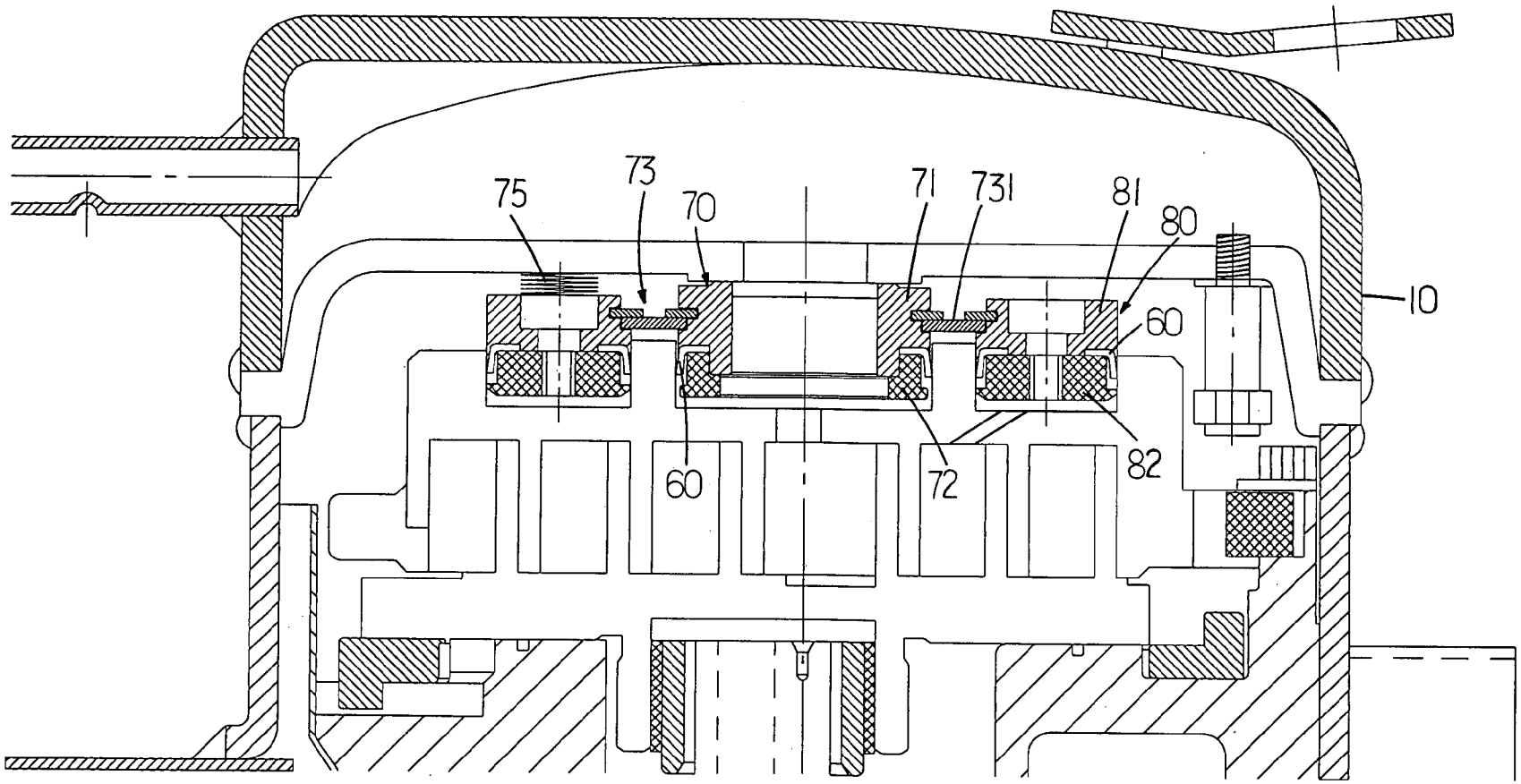
FIG. 3 is a sectional view showing a backpressure mechanism of a second preferred embodiment of the present invention.
Figure 4:
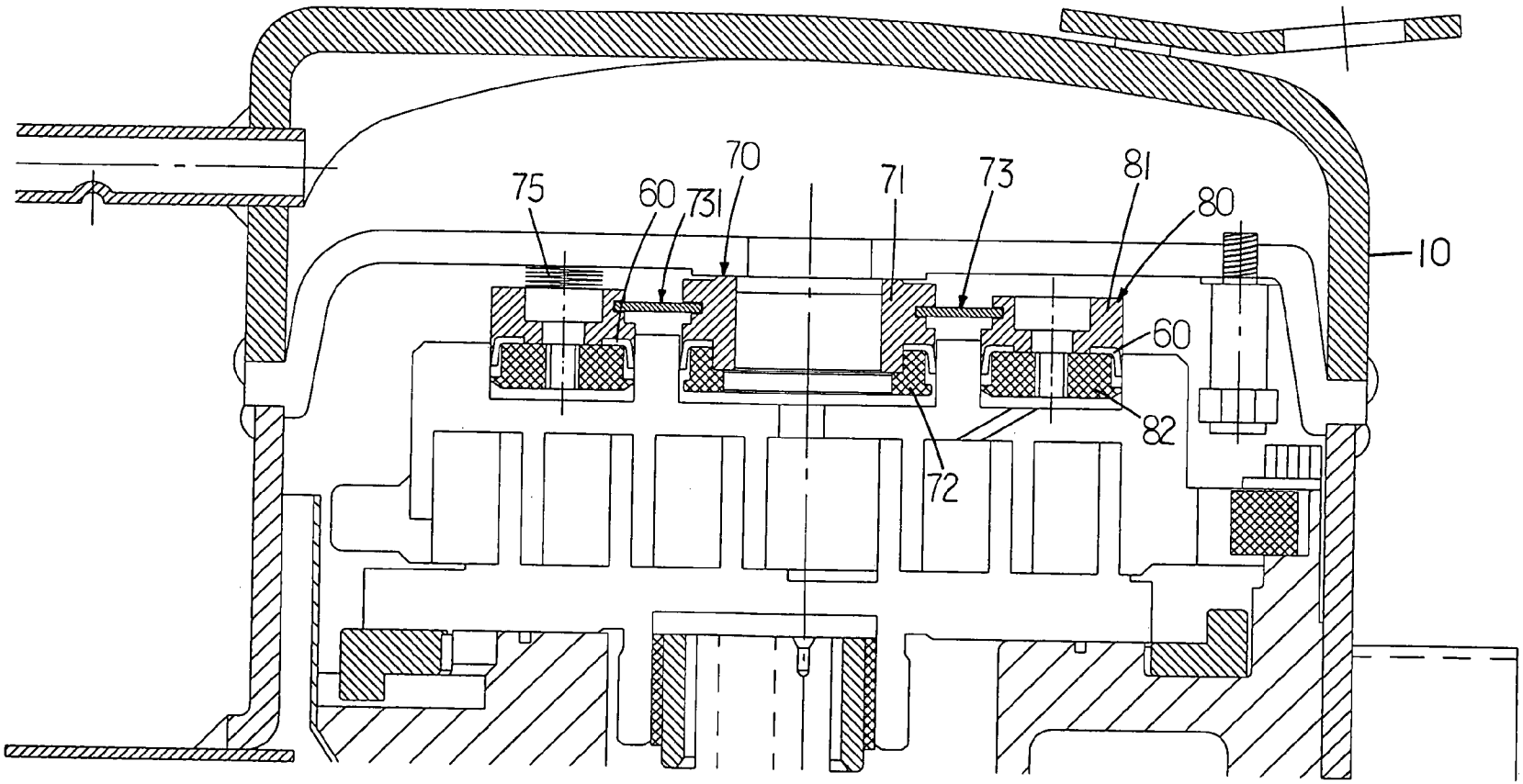
FIG. 4 is a sectional view showing a backpressure mechanism of a third preferred embodiment of the present invention.
Figure 5:
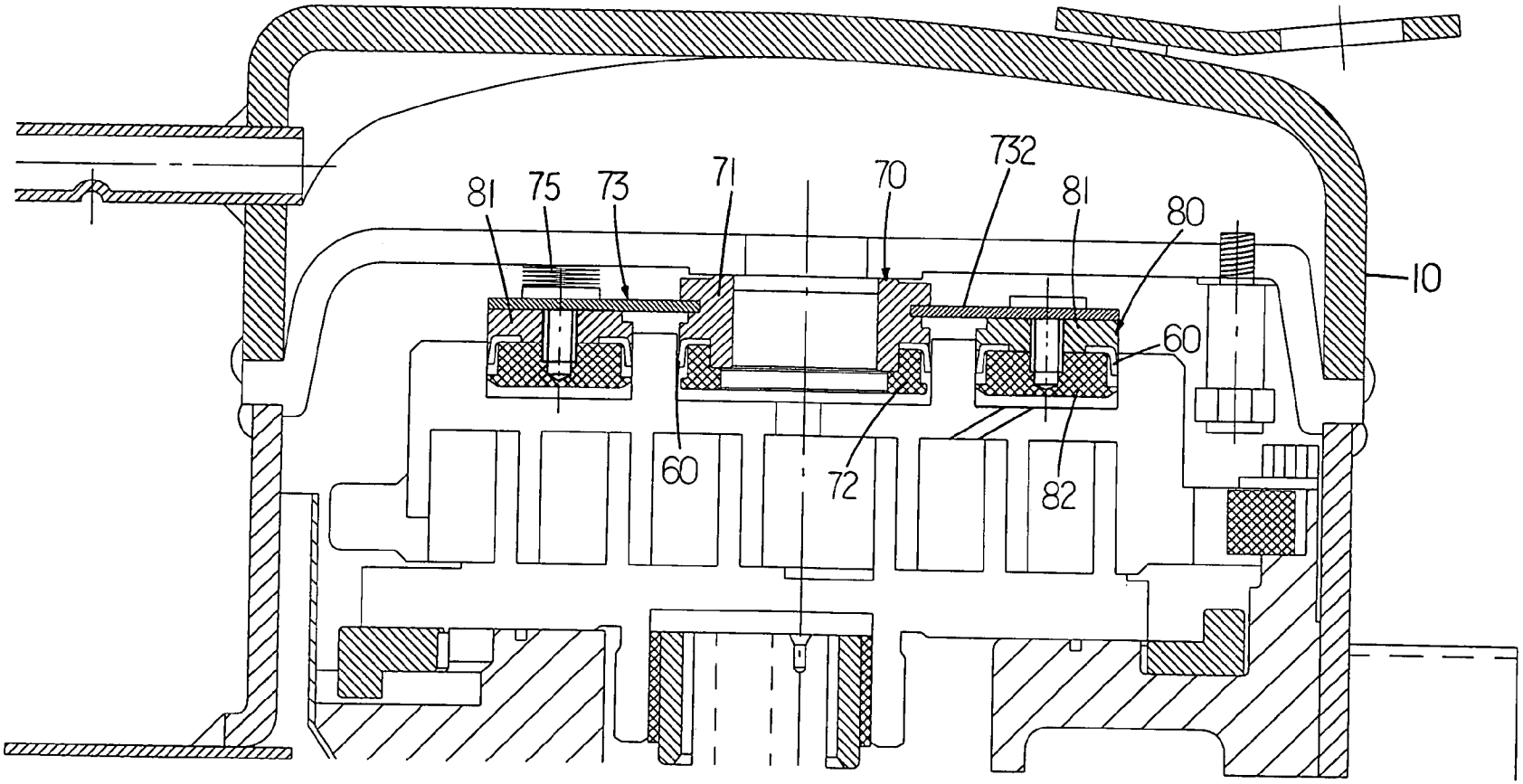
FIG. 5 is a sectional view showing a backpressure mechanism of a fourth preferred embodiment of the present invention.
Figure 6:
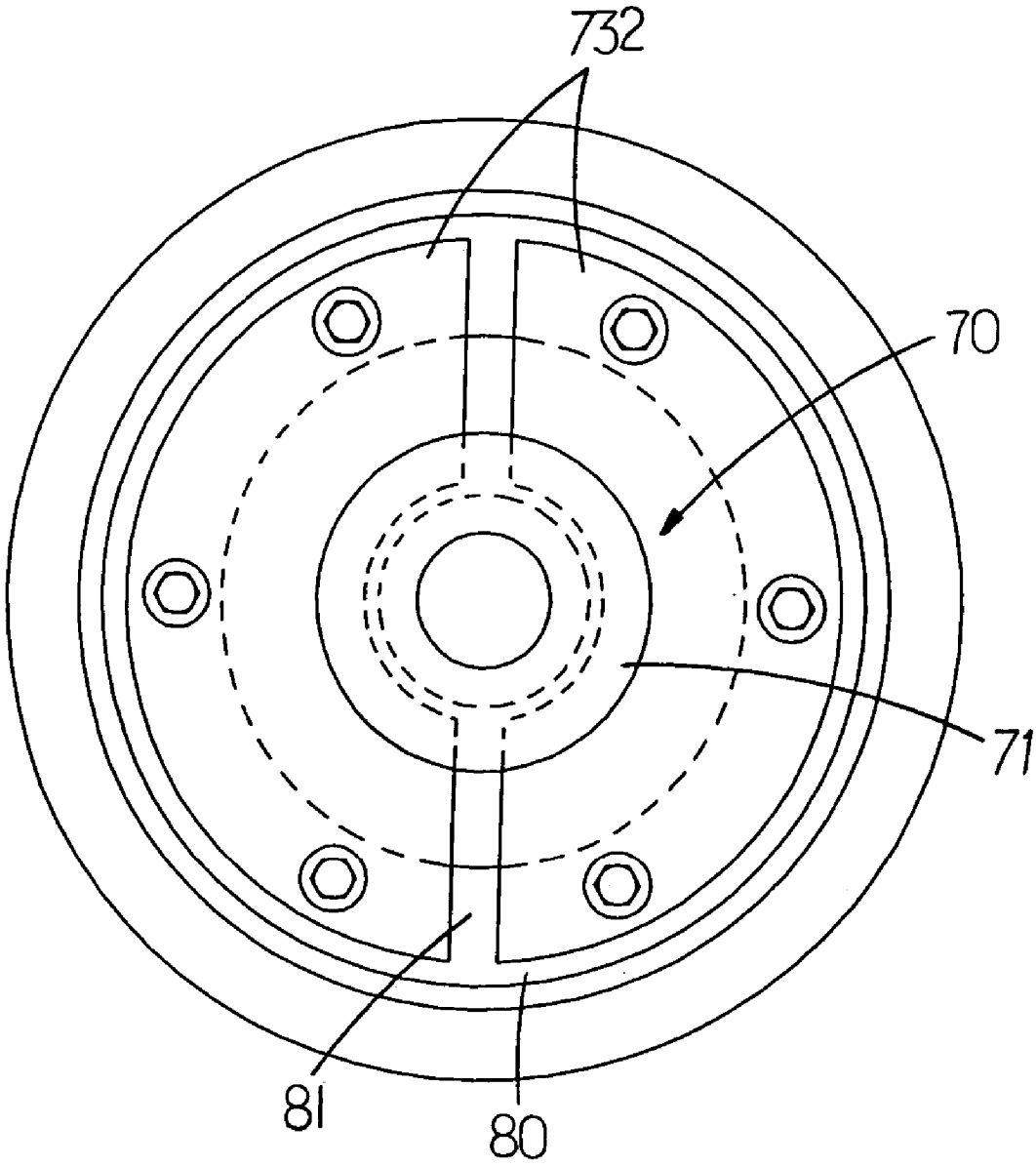
FIG. 6 is a bird's view of the backpressure mechanism of the fourth preferred embodiment of the present invention.
Figure 7:
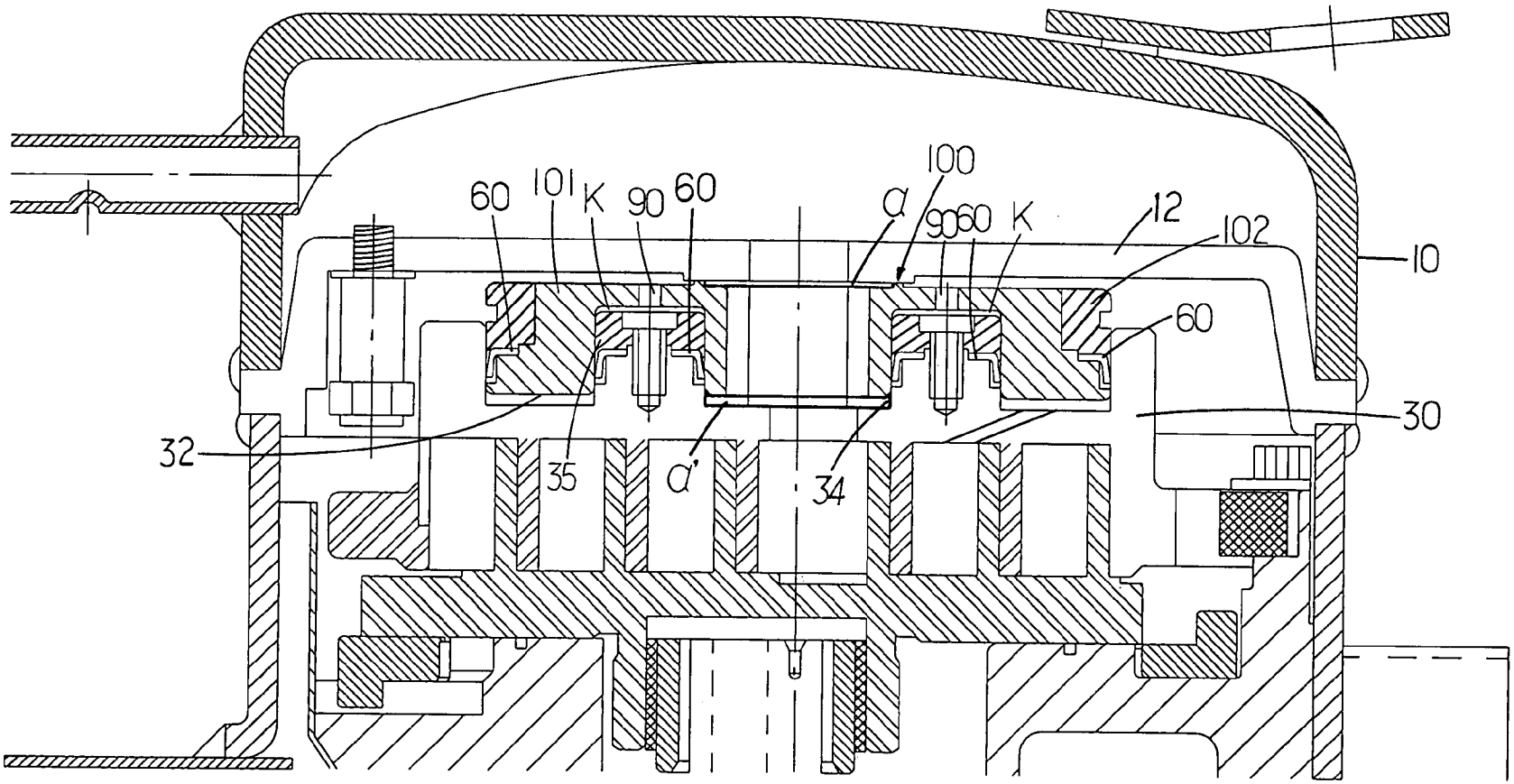
FIG. 7 is a sectional view showing a backpressure mechanism of a fifth preferred embodiment of the present invention.

As illustrated in FIGS. 3 and 4, a linkage 73 is provided at where between the high-pressure and the medium-pressure sealing assemblies 70, 80 in the form of a snap link 731 in the preferred embodiment to make sure of the floating results of the high-pressure sealing assembly 70. The linkage 73 can be also made in the form of having multiple link plates 732 locked to one another into an integrated body as illustrated in FIGS. 5 and 6. Furthermore, a coil 75 is provided at where between the medium-pressure sealing assembly 80 and the separation block 12. Accordingly, in case of any abnormal operation of the compressor, such as the suction is plugged to produce operation in vacuum, both of the high-pressure and the medium-pressure sealing assemblies 70, 80 are plunged downwardly to result in bypass for both of high pressure and medium pressure to prevent the vacuum status inside the casing 10, thus to avoid the danger of causing the motor to burn out due to the presence Now referring to FIG. 7, both of the high-pressure sealing assembly 70 and the medium-pressure sealing assembly 80 are made into an integrated backpressure assembly 100. Wherein, the assembly 100 of the backpressure mechanism further includes a backpressure ring 101 and a press plate 102 with a sealing device 60 separately provided at where between the backpressure ring 101 and the press plate 102. A press plate 35 is locked to the fixed scroll 30 and sealed with the sealing device 60 before the assembly 100 of the backpressure mechanism.

To make sure that the pressure in a space K between the fixed scroll 30 and the assembly 100 of the backpressure mechanism to maintain in low-pressure status, a pore 90 is provided at where appropriately on the backpressure ring 101 that connects through the space K for maintaining the same pressure in the space K and the suction pressure.

Once an area a formed between the top of the high-pressure sealing assembly 70 and the separation block 12 is greater than an area a' formed between the bottom of the high-pressure sealing assembly 70 resulting in vacuuming by the compressor, the backpressure mechanism plunges downwardly to bypass the high pressure to the low pressure for preventing the vacuum status inside the casing 10 to avoid the danger of causing the motor to burn out due to the presence of electric arc.

Figure 8:
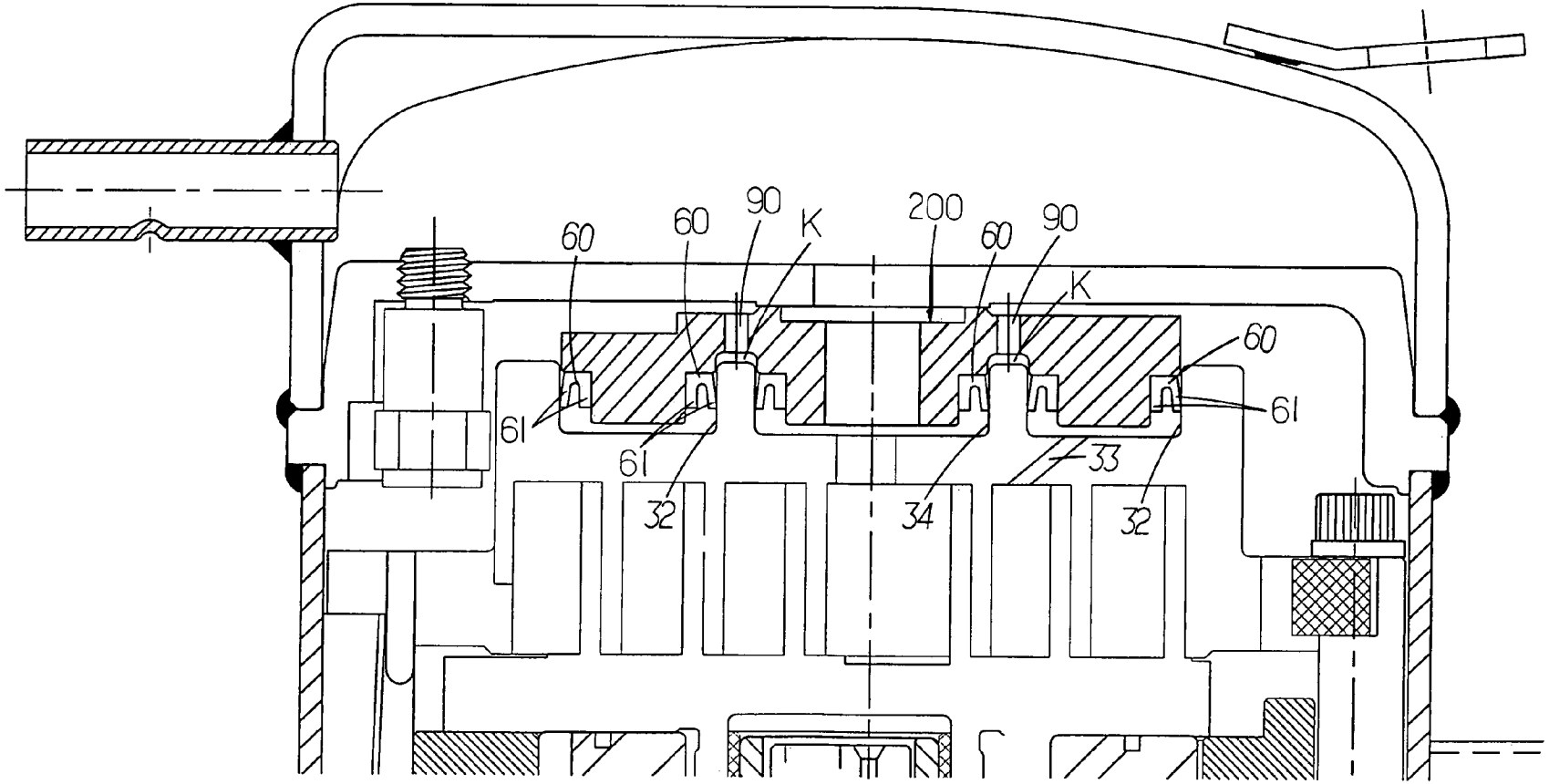
FIG. 8 is a sectional view showing a backpressure mechanism of a sixth preferred embodiment of the present invention.

As illustrated in FIG. 8, both of the high-pressure sealing assembly 70 and the medium-pressure sealing assembly 80 are made into an integrated assembly 200 of the backpressure mechanism with the sealing device 60 disposed within a gap of a sliding contact between the recessed seat 34 and the ring groove 32. Each sealing device 60 is provided with a folded edge 61 to secure close engagement between two contact surfaces for achieving better airtight results. The pressure of the space K between the assembly 200 of the backpressure mechanism in relation to both sealing devices 60 to the high-pressure and the medium-pressure sealing assemblies 70, 80 stays in the same low-pressure status; therefore, the pore 90 connecting through the space K is provided at where appropriately on the backpressure ring 101 to make sure that the pressure in the space K is the same as that of the suction.

As disclosed, the present invention provides an improved structure of a backpressure mechanism for the scroll type compressor, and the application for a utility patent is duly filed accordingly; provided, however, that it is to be noted that the preferred embodiments and the accompanying drawings disclosed in the specification do not in any way restrict the present invention and that any structure, device and characteristics that are similar, or identical with those of the present invention shall be deemed as falling within the objective and the claims of the present invention.

We claim:

1. A backpressure mechanism of a scroll type compressor, wherein, an orbiting scroll revolving around a fixed scroll inside a casing of the compressor; pressure being gradually and inwardly in multiple compression chambers; volume in each compression chamber being altered to compress a coolant; a high-pressure chamber being segregated in the upper space in the casing by means of a separation block; the compressed coolant entering from a compression chamber at the center of the fixed scroll into the high-pressure chamber; a recessed seat being provided on the top of the coolant passage of the fixed scroll; a ring groove being disposed on the outer circumference of the recessed seat; a floating high-pressure sealing assembly being disposed at the recessed seat, and a floating medium-pressure sealing assembly being provided at the ring groove is characterized by that: the high-pressure sealing assembly being comprised of a high-pressure sealing ring, a sealing device and a high-pressure sealing ring seat in the descending order; the medium-pressure sealing assembly being comprised of a medium-pressures sealing ring, a sealing device and a medium-pressure sealing ring seat in the descending order; a bypass pore connecting through a compression chamber being provided at the ring groove of the fixed scroll; both of the high-pressure and the medium-pressure sealing assemblies plunging upwardly against the separation block below the high-pressure chamber; and the pressure from the compressed coolant causing the fixed scroll to produce an axially compromising vacuum unloading to upgrade the operation efficiency of the compressor.

2. A backpressure mechanism of a scroll type compressor as claimed in claim 1, wherein, an elastic member is provided in the ring groove below the high-pressure sealing assembly; the elastic member produces a regular resilience to plunge upwardly the high-pressure sealing assembly; and the high-pressure sealing assembly is fully engaged with the separation block to avoid leakage.

3. A backpressure mechanism of a scroll type compressor as claimed in claim 1, wherein, the elastic member relates to a coil.

* * * * *